US011811144B2

(12) United States Patent
Chen et al.

(10) Patent No.: US 11,811,144 B2
(45) Date of Patent: Nov. 7, 2023

(54) ANTENNA DEVICE

(71) Applicant: CommScope Technologies LLC, Hickory, NC (US)

(72) Inventors: Changfu Chen, Suzhou (CN); Xiaotuo Wang, Suzhou (CN); Xun Zhang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 127 days.

(21) Appl. No.: 17/348,890

(22) Filed: Jun. 16, 2021

(65) Prior Publication Data

US 2021/0399438 A1 Dec. 23, 2021

(30) Foreign Application Priority Data

Jun. 18, 2020 (CN) ..... 202010559668.5

(51) Int. Cl.
*H01Q 15/14* (2006.01)
*H01Q 21/24* (2006.01)
*H01Q 1/52* (2006.01)

(52) U.S. Cl.
CPC ..... *H01Q 21/24* (2013.01); *H01Q 1/52* (2013.01); *H01Q 15/14* (2013.01)

(58) Field of Classification Search
CPC ..... H01Q 21/24; H01Q 1/52; H01Q 15/14
See application file for complete search history.

(56) References Cited

U.S. PATENT DOCUMENTS

2014/0313095 A1* 10/2014 Pu ..... H01Q 1/246 343/836
2018/0248256 A1 8/2018 Xiao et al.
2020/0227812 A1* 7/2020 Sun ..... H01Q 21/061

FOREIGN PATENT DOCUMENTS

CN 108400428 A * 8/2018
CN 108400428 A 8/2018
EP 2784876 A1 10/2014

OTHER PUBLICATIONS

"Extended European Search Report for European Application No. 21179745.1, dated Nov. 12, 2021, 16 pages".

* cited by examiner

*Primary Examiner* — Dieu Hien T Duong
(74) *Attorney, Agent, or Firm* — Myers Bigel, P.A.

(57) ABSTRACT

The present disclosure relates to an antenna device comprising: a first antenna comprising a first reflecting member configured to reflect at least a portion of a signal radiated by the antenna device; a second antenna comprising a second reflecting member configured to reflect at least a portion of the signal radiated by the antenna device, there is a spacing between the first reflecting member and the second reflecting member; and a coupling capacitor comprising a first polar plate and a second polar plate, the first polar plate is disposed on a side, close to the spacing, of a first reflecting surface of the first reflecting member, and the second polar plate is disposed on a side, close to the spacing, of a second reflecting surface of the second reflecting member.

20 Claims, 7 Drawing Sheets

ANTENNA DEVICE

CROSS-REFERENCE TO RELATED APPLICATION

The present application claims priority to Chinese Patent Application No. 202010559668.5, filed with the China National Intellectual Property Administration on Jun. 18, 2020, with the entire contents of the above-identified application incorporated by reference as if set forth herein.

TECHNICAL FIELD

The present disclosure relates to the field of communication technologies, and in particular, to an antenna device.

BACKGROUND

An antenna device may comprise at least two antennas that are separately provided, which may provide performance improvements of the antenna device, facilitate flexible configuration of the antenna device, and/or provide other benefits. In such an antenna device, a signal radiated toward the front side of the antenna device may leak to the rear side of the antenna device through a space between two adjacent antennas, resulting in a radiation degraded front-to-back ratio for the antenna device.

SUMMARY

It is one of the objectives of the present disclosure to provide an antenna device.

According to some aspects of the present disclosure, there is provided an antenna device comprising: a first antenna comprising a first reflecting member configured to reflect at least a portion of a signal radiated by the antenna device; a second antenna comprising a second reflecting member configured to reflect at least a portion of the signal radiated by the antenna device, wherein there is a spacing between the first reflecting member and the second reflecting member; and a coupling capacitor comprising a first polar plate and a second polar plate, wherein the first polar plate is disposed on a side, close to the spacing, of a first reflecting surface of the first reflecting member, and the second polar plate is disposed on a side, close to the spacing, of a second reflecting surface of the second reflecting member.

According to some aspects of the present disclosure, there is provided an antenna device comprising: a first antenna comprising a first reflecting member that comprises a first reflecting plate configured to reflect at least a portion of a signal radiated by the antenna device and a first polar plate bent at a first preset angle relative to the first reflecting plate; a second antenna comprising a second reflecting member that comprises a second reflecting plate configured to reflect at least a portion of the signal radiated by the antenna device and a second polar plate bent at a second preset angle relative to the second reflecting plate, and there is a spacing between the first reflecting member and the second reflecting member; wherein the first polar plate and the second polar plate are disposed close to the spacing, and the first polar plate and the second polar plate form a coupling capacitor.

According to some aspects of the present disclosure, there is provided an antenna device comprising: a first antenna comprising a first reflecting member configured to reflect at least a portion of a signal radiated by the antenna device; a second antenna comprising a second reflecting member configured to reflect at least a portion of the signal radiated by the antenna device, wherein there is a spacing between the first reflecting member and the second reflecting member; and a capacitive polar plate disposed close to the spacing, wherein the capacitive polar plate and at least one of the first reflecting member and the second reflecting member form a coupling capacitor.

Other features and aspects of the present disclosure and advantages thereof will become more apparent from the following detailed description of exemplary embodiments of the present disclosure, which proceeds with reference to the accompanying drawings.

BRIEF DESCRIPTION OF THE DRAWINGS

The accompanying drawings, which constitute a part of the specification, illustrate embodiments of the present disclosure and, together with the description, serve to explain the principles of the present disclosure.

The present disclosure will be better understood according to the following detailed description with reference of the accompanying drawings, wherein.

Figure 1:
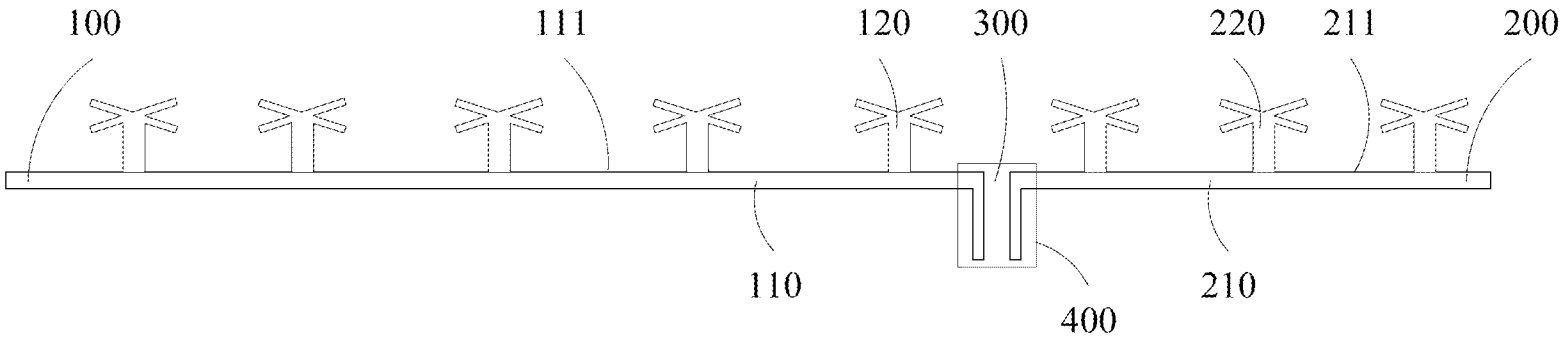
FIG. 1 is a schematic side view of a partial structure of an antenna device according to an exemplary embodiment of the present disclosure.

Note that, in the embodiments described below, in some cases the same portions or portions having similar functions are denoted by the same reference numerals in different drawings, and description of such portions is not repeated. In some cases, similar reference numerals and letters are used to refer to similar items, and thus once an item is defined in one figure, it need not be further discussed for following figures.

In order to facilitate understanding, the position, the size, the range, or the like of each structure illustrated in the drawings and the like are not accurately represented in some cases. Thus, the disclosure is not necessarily limited to the position, size, range, or the like as disclosed in the drawings and the like.

DETAILED DESCRIPTION

Various exemplary embodiments of the present disclosure will be described in detail with reference to the accompanying drawings. It should be noted that the relative arrangement of the components and steps, the numerical expressions, and numerical values set forth in these embodiments do not limit the scope of the present disclosure unless it is specifically stated otherwise.

The following description of at least one exemplary embodiment is merely illustrative in nature and is in no way intended to limit this disclosure, its application, or uses. That is to say, the structure and method herein are illustrated by way of example to explain different embodiments of the structure and method of the present disclosure. It should be understood by those skilled in the art that, these examples, while indicating the implementations of the present disclosure, are given by way of illustration only, but not in an exhaustive way. In addition, the drawings are not necessarily drawn to scale, and some features may be enlarged to show details of some specific components.

Techniques, methods and devices as known by one of ordinary skill in the relevant art may not be discussed in detail, but are intended to be regarded as a part of the specification where appropriate.

In all of the examples as illustrated and discussed herein, any specific values should be interpreted to be illustrative only and non-limiting. Thus, other examples of the exemplary embodiments could have different values.

The present disclosure provides an antenna device that includes a first antenna and a second antenna, in which a coupling capacitor is additionally provided at a spacing between the first antenna and the second antenna, so as to suppress a signal radiated by the antenna device from leaking to the rear side of the antenna device through the spacing, so that the antenna device still can maintain a high front-to-back ratio, thereby improving the radiation performance of the antenna device.

According to an exemplary embodiment of the present disclosure, as shown in FIG. 1, the antenna device may include a first antenna 100, a second antenna 200, and a coupling capacitor 400.

The first antenna 100 may include a first reflecting member 110 configured to reflect at least a portion of a signal radiated by the antenna device, and specifically, the first reflecting member 110 may reflect at least a portion of a signal radiated by the first antenna 100 and may also reflect a portion of a signal radiated by the second antenna 200, as described below. A first reflecting surface 111 of the first reflecting member 110 is disposed toward the front side of the antenna device to reflect backwardly directed radiation forwardly. The first reflecting surface 111 may be a planar or curved surface according to different requirements. Hereinafter, the first reflecting surface 111 will be described as a planar surface for example, but it is understood that embodiments of the present disclosure are not limited thereto. In some embodiments, the first reflecting member 110 may be formed of a conductive metal material, or the first reflecting member 110 may include other material and a metal thin film deposited on the surface of the material or the like.

As shown in FIG. 1, the first antenna 100 may also include one or more antenna elements 120. The antenna elements 120 project forwardly from the first reflecting surface 111. A portion of the signal radiated forwardly by the antenna element 120 will be radiated directly into the front space, and a portion of the signal radiated backwardly by the antenna element 120 will be reflected forwardly by at least the first reflecting surface 111 (and a portion of the signal may be also reflected by a second reflecting surface 211 as described below). The antenna elements 120 may include only a single type of antenna element corresponding to a single frequency band, or may include multiple types of antenna elements corresponding to multiple frequency bands or having other different properties. Furthermore, the plurality of antenna elements 120 may be arranged in various ways, so that the signal radiated by the first antenna 100 may meet one or more specific requirements.

Figure 2:
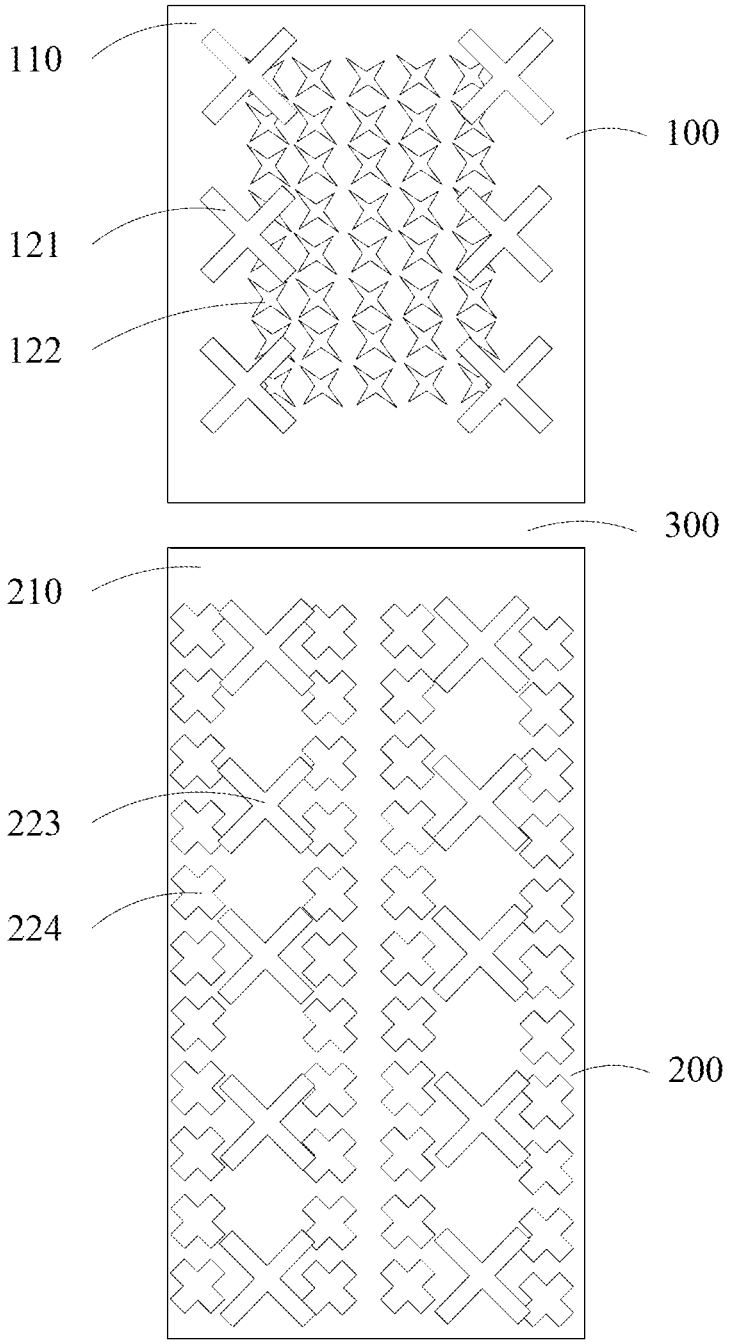
FIG. 2 is a schematic front view of a partial structure of an antenna device according to a specific embodiment of the present disclosure.

In some embodiments, as shown in FIG. 2, the first antenna 100 may include a plurality of first antenna elements 121 arranged in an array and a plurality of second antenna elements 122 arranged in an array. The first antenna element 121 may be configured to radiate a first signal within a first frequency band and the second antenna element 122 may be configured to radiate a second signal within a second frequency band. In some embodiments, at least some frequencies in the second frequency band are higher than the highest frequency in the first frequency band. That is, the first antenna 100 may radiate respective signals in two different frequency bands via the first and second antenna elements 121 and 122, respectively. For example, the first antenna elements 121 may be configured to radiate signals in the 617-960 MHZ frequency band or a portion thereof and the second antenna elements 122 may be configured to radiate signals in the 1695-2690 MHZ frequency band or a portion thereof. In the depicted embodiment, two columns of first antenna elements 121 are provided and six columns of second antenna elements 122 are provided.

As shown in FIG. 1, the second antenna 200 may include a second reflecting member 210 configured to reflect at least a portion of the signal radiated by the antenna device, and specifically, the second reflecting member 210 may reflect at least a portion of the signal radiated by the second antenna 200 and may also reflect a portion of the signal radiated by the first antenna 100. The second reflecting surface 211 of the second reflecting member 210 is disposed toward the front side of the antenna device to radiate the signal forwardly. The second reflecting surface 211 may be a planar or a curved surface according to different requirements. Hereinafter, the second reflecting surface 211 will be described as a planar surface for example, but it is understood that embodiments of the present disclosure are not limited thereto. In some embodiments, the second reflecting member 210 may be formed of a conductive metal material, or the second reflecting member 210 may include other material and a metal thin film deposited on the surface of the material or the like.

As shown in FIG. 1, the second antenna 200 may further include one or more antenna elements 220 that project forwardly from the second reflecting surface 211. In this case, a portion of the signal radiated forwardly by the antenna element 220 will be radiated directly into the front space, and a portion of the signal radiated backwardly by the antenna element 220 will be reflected forwardly by at least the second reflecting surface 211 (and a portion of the signal may be also reflected by the first reflecting surface 111). The antenna element 220 may include only a single type of antenna element corresponding to a single frequency band, or may include multiple types of antenna elements corresponding to multiple frequency bands or having other different properties. Furthermore, the plurality of antenna elements 220 may be arranged in various ways, so that the signal radiated by the second antenna 200 may meet one or more specific requirements.

In some embodiments, as shown in FIG. 2, the second antenna 200 may include a plurality of third antenna elements 223 arranged in an array and a plurality of fourth antenna elements 224 arranged in an array. The third antenna element 223 may be configured to radiate a third signal within a third frequency band and the fourth antenna element 224 may be configured to radiate a fourth signal within a fourth frequency band. In a specific example, the third frequency band is the first frequency band, and the third signal is the first signal. That is, in this case, the first antenna element 121 in the first antenna 100 and the third antenna element 223 in the second antenna 200 participate in radiating the first signal within the first frequency band together. In other words, the first antenna 100 and the second antenna 200 can be regarded as one complete antenna for the first signal. In some embodiments, at least some frequencies in the fourth frequency band are higher than the highest frequency in the third frequency band or the first frequency band. The fourth frequency band may be the same as or different from the second frequency band. In the particular embodiment shown in FIG. 2, the second antenna 200 may radiate respective signals in two different frequency bands via the third and fourth antenna elements 223 and 224, respectively. For example, the third antenna elements 223 and the fourth antenna elements 224 may be arranged according to a 2L4H layout as shown in FIG. 2, wherein the third antenna elements 223 form a column between two columns of the fourth antenna elements 224.

As shown in FIG. 1 and FIG. 2, the first antenna 100 and the second antenna 200 may be separately provided and electrically connected through, for example, a blind-mate connector or the like. Accordingly, there is a spacing 300 between the first reflecting member 110 and the second reflecting member 210. The first antenna 100 and the second antenna 200 may be arranged in an up-down direction (i.e., may be vertically stacked). As shown in FIG. 2, the second antenna 200 is disposed below the first antenna 100. However, it is understood that the first antenna 100 and the second antenna 200 may be arranged in other manners (for example, arranged in a left-right direction, etc.), and are not limited to the arrangement shown in the figures and described herein.

In some embodiments, as shown in FIG. 1 and FIG. 2, the first reflecting surface 111 and the second reflecting surface 211 may be disposed to be coplanar with each other, so as to help avoid mutual interference between the first antenna 100 and the second antenna 200, and improve the radiation effect of the antenna device.

In some embodiments, both the first antenna 100 and the second antenna 200 may be passive antennas. Alternatively, in some other embodiments, at least one of the first antenna 100 and the second antenna 200 may include an active apparatus 500 (see FIG. 3). The active apparatus 500 may include circuits or components such as a receiving module, an amplifying module, a power supply module and the like. The active apparatus 500 may be disposed rearwardly of the first reflecting member 110 and/or the second reflecting member 210.

Figure 3:
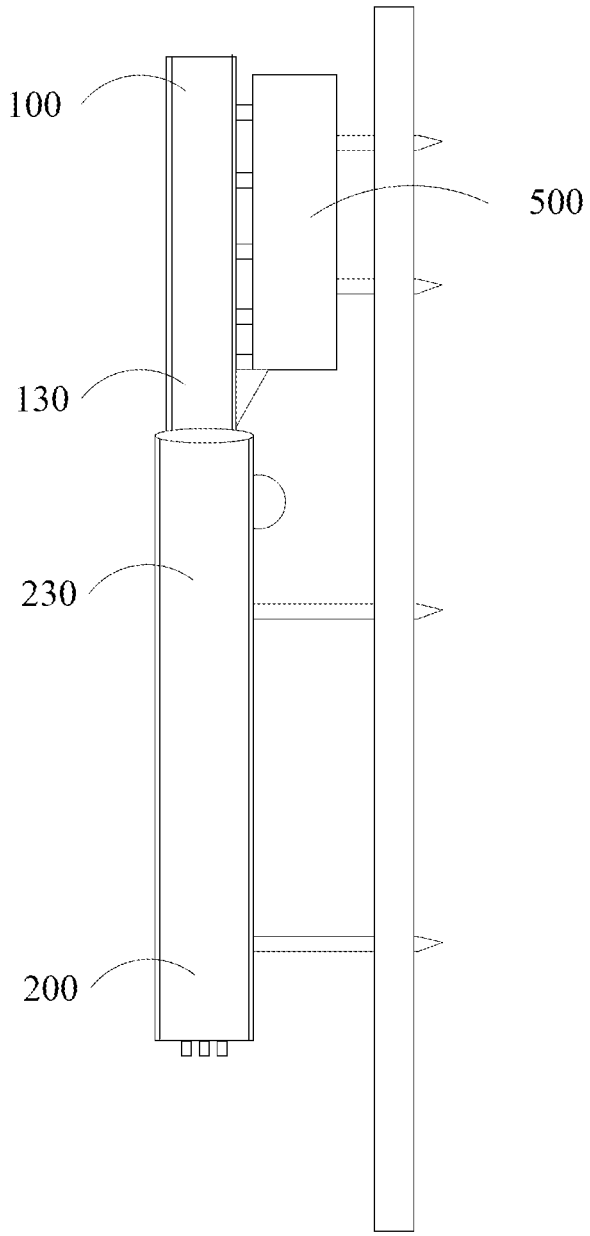
FIG. 3 is a schematic side view of an external structure of an antenna device according to a specific embodiment of the present disclosure.

In a specific embodiment shown in FIG. 3, the first antenna 100 may include the active apparatus 500 that may be electrically connected to at least some of the antenna elements 120 in the first antenna 100. For example, the active apparatus 500 may be electrically connected to the second antenna elements 122 in the first antenna 100 shown in FIG. 2. In other embodiments, the active apparatus 500 may also be electrically connected to the second antenna 200, or a first active apparatus 500 may be included in the first antenna 100 and a second active apparatus 500 may be included in the second antenna 200.

Figure 4:
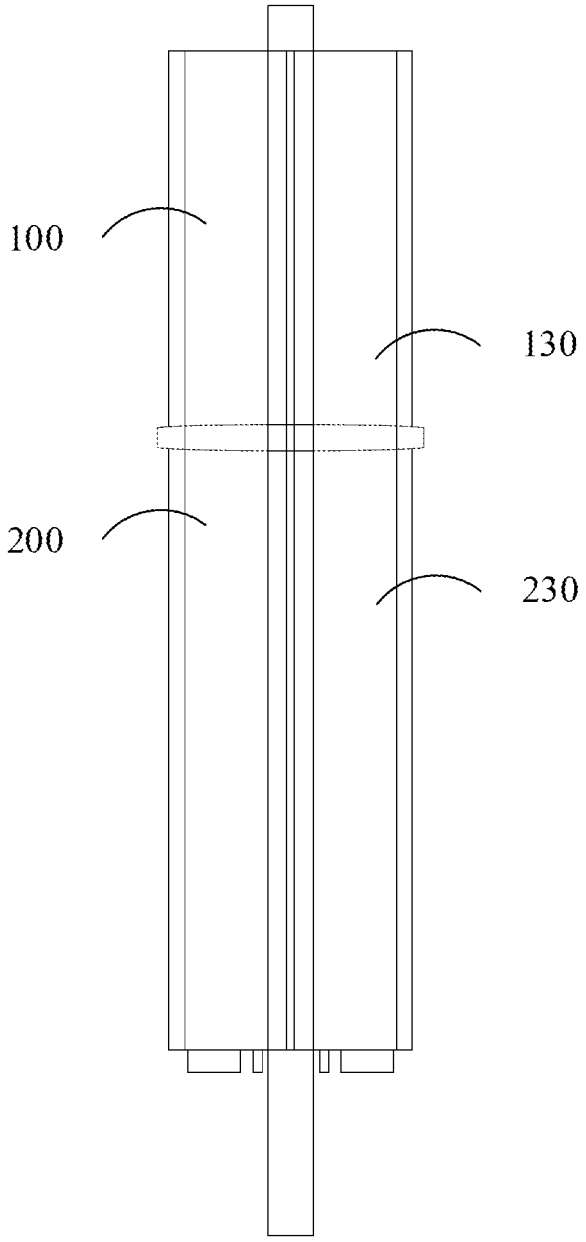
FIG. 4 is a schematic front view of an external structure of an antenna device according to a specific embodiment of the present disclosure.

As shown in FIG. 3 and FIG. 4, the first antenna 100 may include a first radome 130, and/or the second antenna 200 may include a second radome 230. The radomes 130, 230 can protect the antennas 100, 200 from the external environment. The radomes 130, 230 may be substantially transparent to electromagnetic radiation in the operating frequency bands of the respective antennas 100, 200 and can withstand external severe environment in mechanical performance to prevent damage from rain, ice, snow, sand, solar radiation and the like to the antennas 100, 200. In the specific embodiment shown in FIG. 3 and FIG. 4, the first reflecting member 110 and the antenna elements 120 of the first antenna 100 may be arranged within the first radome 130, and the second reflecting member 210 and the antenna elements 220 of the second antenna 200 may be arranged within the second radome 230. Furthermore, the active apparatus 500 of the first antenna 100 may be disposed outside the first radome 130, and on the rear side of the first radome 130.

As shown in FIG. 1, the coupling capacitor 400 may include the spacing 300 along with a first polar plate 410 and a second polar plate 420. The first polar plate 410 and the second polar plate 420 may be disposed close to, proximate to, or adjacent to the spacing 300. For example, the first polar plate 410 may be on a side of the first reflecting surface 111 of the first reflecting member 110 that is close to or adjacent to the spacing 300, and the second polar plate 420 may be on a side of the second reflecting surface 211 of the second reflecting member 210 that is close to or adjacent to the spacing 300. The coupling capacitor 400 may suppress the signal radiated by the antenna device from leaking to the rear side of the antenna device through the spacing 300. In particular, the influence of the spacing 300 on the signal transmission will be greatly reduced due to the presence of the coupling capacitor 400, and when the capacitance of the coupling capacitor 400 is sufficiently large, the signal transmission will be similar to that in the case where the spacing 300 is absent (i.e., the antenna device has a complete reflecting member or reflecting surface).

The capacitance of the coupling capacitor 400 is generally decided by its structural parameter, which may specifically include an effective capacitor area and an effective capacitor separation of the coupling capacitor 400. The effective capacitor area may correspond to an area in which some or all of the first polar plate 410 overlaps with some or all of the second polar plate 420, and the effective capacitor separation may be the distance between overlapping portions of the first polar plate 410 and the second polar plate 420. In many cases the separation between the first antenna 100 and the second antenna 200 in the antenna device may be fixed, and this may effectively fix the effective capacitor separation. Therefore, the capacitance of the coupling capacitor 400 can be adjusted to an appropriate value by adjusting the effective capacitor area, i.e., the area where the first polar plate 410 and the second polar plate 420 overlap. Although a sufficient capacitance may often be obtained by making the overlapping area large, the increased sizes of the first polar plate 410 and the second polar plate 420 may place high demands on a space in the antenna device for arranging the coupling capacitor 400. Thus, space limitations may limit the size of the first and second polar plates 410, 420, and hence the effective capacitor area.

In general, the influence of the spacing 300 is more significant on relatively low frequency signals than that on relatively high frequency signals. Therefore, in determining the structural parameters of the coupling capacitor 400 may be configured according to a portion of the signal radiated by the antenna device having the lowest frequency. When the radiation effect of the portion of the signal having the lowest frequency can meet the requirement, the radiation effect of a portion of the signal having higher frequencies can also meet the requirement in general.

In some embodiments, as shown in FIGS. 5-12, the first polar plate 410 and the second polar plate 420 are parallel to each other to utilize the limited space as much as possible, so that the capacitance of the coupling capacitor 400 is large enough to improve the radiation effect of the antenna device.

In some embodiments, as shown in FIGS. 5-12, the first polar plate 410 and the second polar plate 420 are disposed completely opposite each other. Compared with the case in which the first polar plate 410 and the second polar plate 420 are arranged in an offset manner, such an arrangement can obtain a larger effective capacitor area, thereby obtaining a larger capacitance, to improve the radiation effect of the antenna device.

In some embodiments, as shown in FIGS. 5-12, the first polar plate 410 may be disposed perpendicularly to the first reflecting surface 111, and the second polar plate 420 may be disposed perpendicularly to the second reflecting surface 211, so as to help simplify a manufacturing process of the coupling capacitor 400 and improve the radiation effect of the antenna device.

The direction in which the first polar plate 410 extends relative to the first reflecting surface 111 and the direction in which the second polar plate 420 extends relative to the second reflecting surface 211 can be determined according to the arranged positions of other components and structures in the antenna device, so as to avoid the first polar plate 410 and the second polar plate 420 having adverse effects on other components of the antenna device. In order to make the capacitance of the coupling capacitor 400 be as large as possible, the first polar plate 410 and the second polar plate 420 may extend in the same direction, although embodiments of the present invention are not limited thereto.

Figure 5:
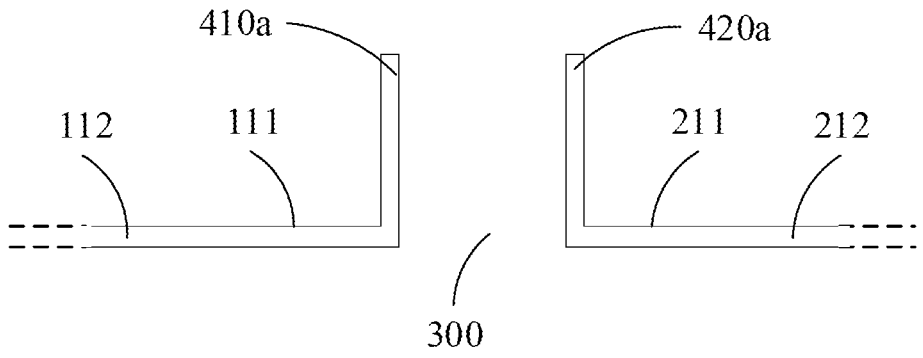
FIG. 5 is a schematic diagram of a partial structure of an antenna device according to a first specific example of the present disclosure.
Figure 8:
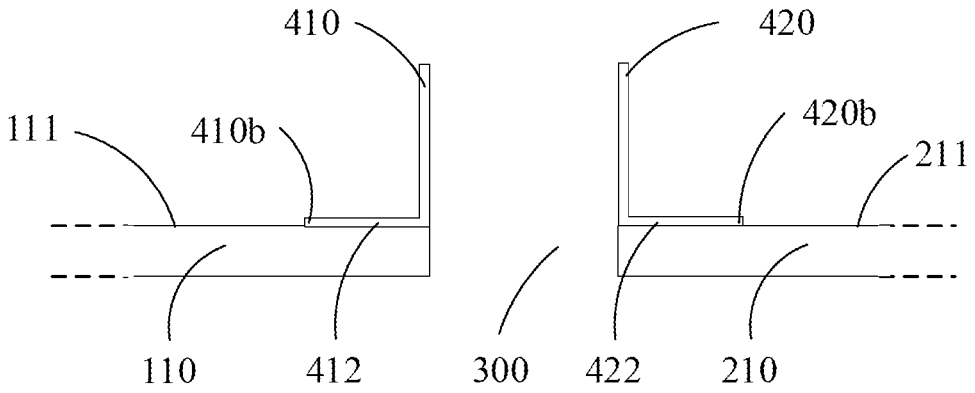
FIG. 8 is a schematic diagram of a partial structure of an antenna device according to a fourth specific example of the present disclosure.
Figure 11:
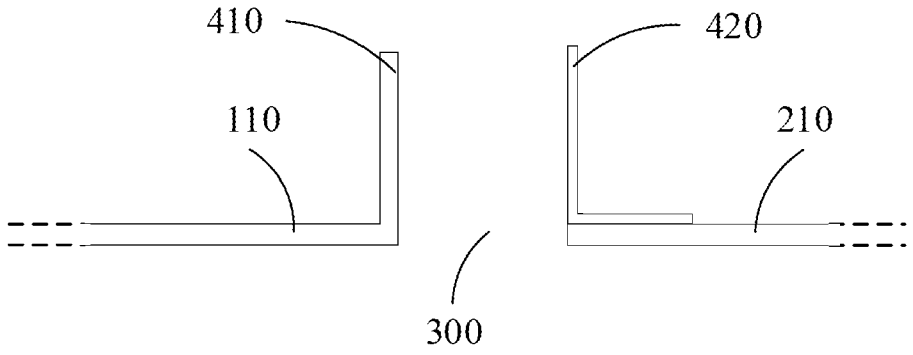
FIG. 11 is a schematic diagram of a partial structure of an antenna device according to a seventh specific example of the present disclosure.

In some embodiments, as shown in FIGS. 5, 8, and 11, the first polar plate 410 may extend toward the front side of the antenna device relative to the first reflecting surface 111, and the second polar plate 420 may extend toward the front side of the antenna device relative to the second reflecting surface 211.

Figure 6:
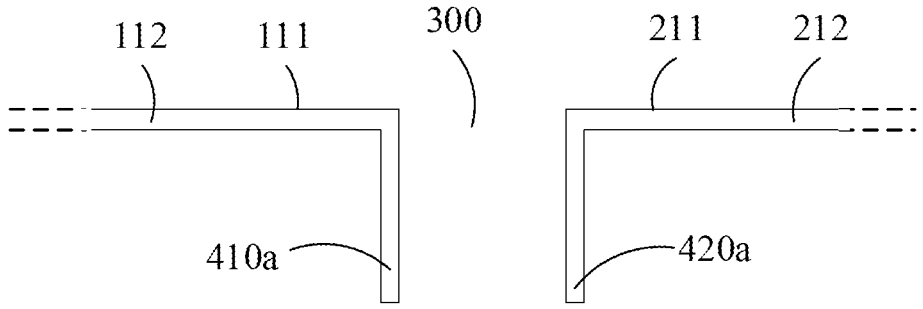
FIG. 6 is a schematic diagram of a partial structure of an antenna device according to a second specific example of the present disclosure.
Figure 9:
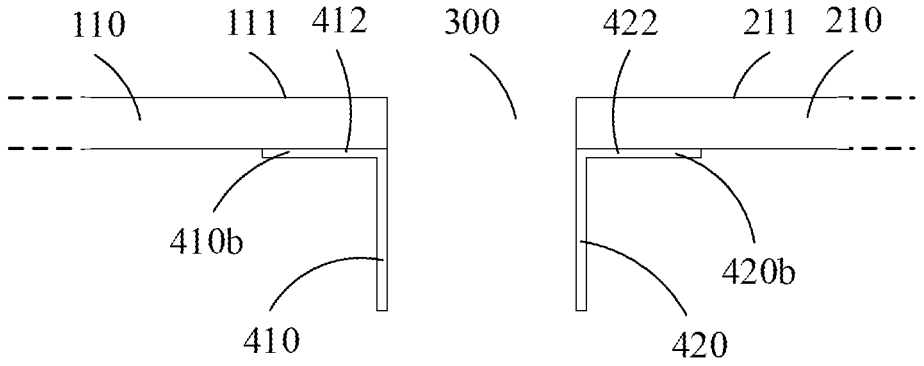
FIG. 9 is a schematic diagram of a partial structure of an antenna device according to a fifth specific example of the present disclosure.

In some embodiments, as shown in FIGS. 6 and 9, the first polar plate 410 may extend toward the rear side of the antenna device relative to the first reflecting surface 111, and the second polar plate 420 may extend toward the rear side of the antenna device relative to the second reflecting surface 211.

Figure 7:
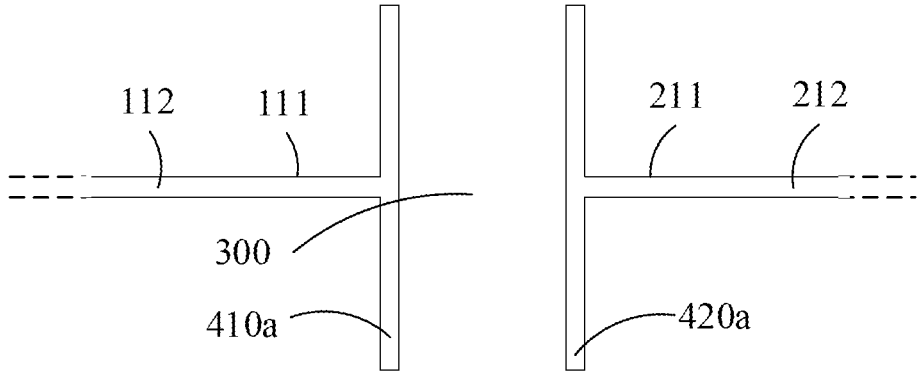
FIG. 7 is a schematic diagram of a partial structure of an antenna device according to a third specific example of the present disclosure.
Figure 10:
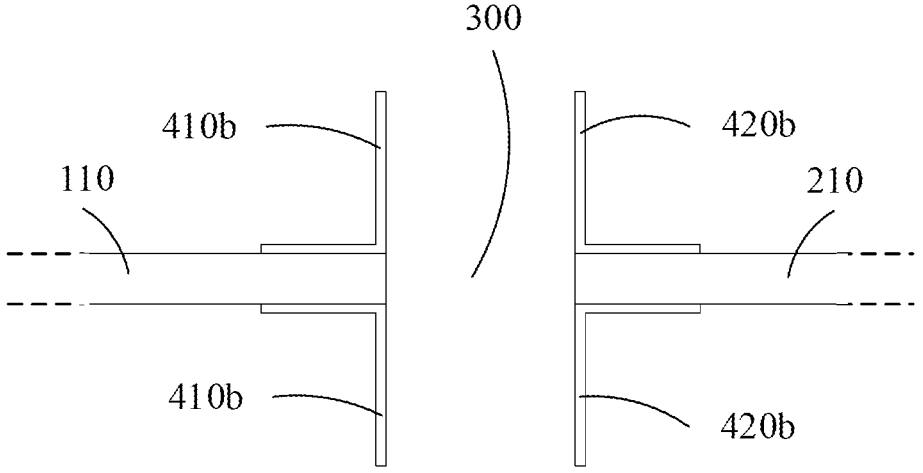
FIG. 10 is a schematic diagram of a partial structure of an antenna device according to a sixth specific example of the present disclosure.
Figure 12:
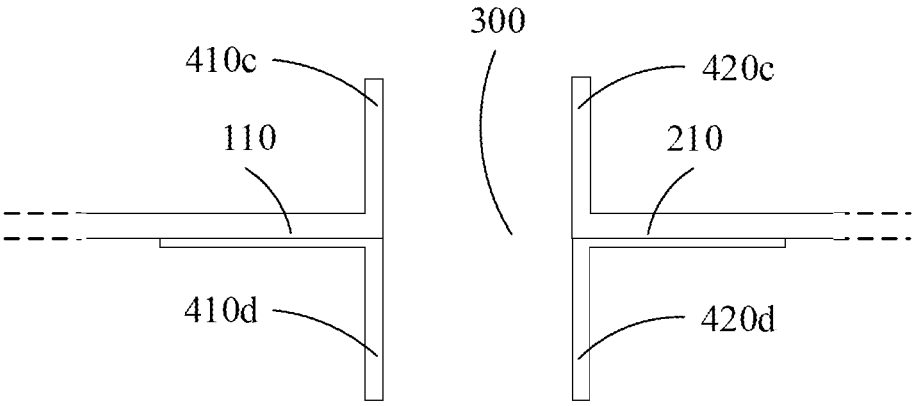
FIG. 12 is a schematic diagram of a partial structure of an antenna device according to an eighth specific example of the present disclosure.

In some embodiments, as shown in FIGS. 7, 10, and 12, the first polar plate 410 may extend toward both the front and rear sides of the antenna device relative to the first reflecting surface 111, and the second polar plate 420 may extend toward both the front and rear sides of the antenna device relative to the second reflecting surface 211, to further increase the capacitance of the coupling capacitor 400.

The first polar plate 410 and the second polar plate 420 may be formed in various ways.

In some embodiments, as shown in FIGS. 5-7, the first reflecting member 110 may include a first conductive plate 410*a* disposed at an angle relative to the first reflecting surface 111, and the first conductive plate 410*a* may form the first polar plate 410. The second reflecting member 210 may include a second conductive plate 420*a* disposed at an angle relative to the second reflecting surface 211, and the second conductive plate 420*a* may form the second polar plate 420.

Specifically, the first polar plate 410 may be formed by bending the first reflecting member 110 at a first preset angle relative to a first reflecting plate 112, where the first reflecting plate 112 is a planar plate that includes the first reflecting surface 111. The second polar plate 420 may be formed by bending the second reflecting member 210 at a second preset angle relative to a second reflecting plate 212, where the second reflecting plate 212 is a planar plate that includes the second reflecting surface 211. In other words, the first reflecting plate 112 may be formed integrally with the first polar plate 410, and the second reflecting plate 212 may be formed integrally with the second polar plate 420, thereby simplifying the manufacturing process of the coupling capacitor 400.

In some embodiments, the first preset angle may be a right angle, and the second preset angle may be a right angle, which may help simplify the manufacturing process of the coupling capacitor 400 and improve the radiation effect of the antenna device.

In some embodiments, the first reflecting member 110 is disposed entirely within the first radome 130 and the second reflecting member 210 is disposed entirely within the second radome 230, and accordingly, the first polar plate 410 and the second polar plate 420 of the coupling capacitor 400 may be disposed within the first radome 130 and the second radome 230, respectively. The first radome 130 and the second radome 230 will not adversely affect the coupling effect of the coupling capacitor 400, and can protect the first polar plate 410 and the second polar plate 420, thereby improving the radiation effect of the antenna device.

In some embodiments, as shown in FIGS. 8-10, the antenna device may include a first capacitive member 410*b* and a second capacitive member 420*b*. The first capacitive member 410*b* may be a separate structure from the first reflecting member 110, and at least a portion of the first capacitive member 410*b* may be configured to form the first polar plate 410. The second capacitive member 420*b* may be a separate structure from the second reflecting member 210, and at least a portion of the second capacitive member 420*b* may be configured to form the second polar plate 420.

Further, the first capacitive member 410*b* may include a first fixing portion 412 connected with the first polar plate 410, and the first fixing portion 412 may be configured to be mechanically connected to the first reflecting member 110. The second capacitive member 420*b* may include a second fixing portion 422 connected with the second polar plate 420, and the second fixing portion 422 may be configured to be mechanically connected to the second reflecting member 210.

In the specific examples shown in FIGS. 8-10, the first fixing portion 412 may include a first fixing plate, and the first fixing plate may be connected to the first reflecting member 110 in parallel to the first reflecting surface 111. The second fixing portion 422 may include a second fixing plate, and the second fixing plate 422 may be connected to the second reflecting member 210 in parallel to the second reflecting surface 211.

It is understood that in specific examples and embodiments, the first fixing portion 412 and/or the second fixing portion 422 may include screws, bolts, and fasteners or other components or assemblies for connection.

Different ways of disposing the first polar plate 410 and the second polar plate 420 of the coupling capacitor 400 may also be combined with each other. In the specific example shown in FIG. 11, the first polar plate 410 of the coupling capacitor 400 may be a portion 410*a* of the first reflecting member 110 that is formed by bending the first reflecting member 110, and the second polar plate 420 may be formed by a portion of the second capacitive member 420*b* that is independent of the second reflecting member 210.

In the specific example shown in FIG. 12, the first polar plate 410 may also be formed of two parts, with the first part 410*c* formed by bending the first reflecting member 110, and the second part 410*d* formed of at least a portion of the first capacitive member that is independent of the first reflecting member 110. Similarly, the second polar plate 420 may also be formed of two parts, with the first part 420*c* formed by bending the second reflecting member 210, and the second part 420*d* formed of at least a portion of the first capacitive member that is independent of the second reflecting member 210.

It is to be understood that the above embodiments may be combined in other ways, even though descriptions of such combinations are omitted herein in the interest of brevity.

Figure 13:
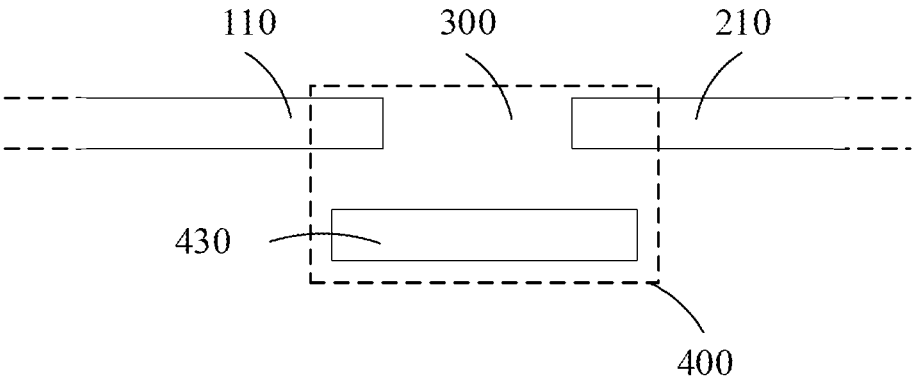
FIG. 13 is a schematic diagram of a partial structure of an antenna device according to another exemplary embodiment of the present disclosure.

According to another exemplary embodiment of the present disclosure, as shown in FIG. 13, the coupling capacitor 400 in the antenna device may be formed by the first reflecting member 110 of the first antenna, the second reflecting member 210 of the second antenna, and an additionally provided capacitive polar plate 430.

The basic configurations of the first antenna and the second antenna in an antenna device according to the embodiment of FIG. 13 may be as in the above description, and descriptions thereof are not repeated herein. Instead, differences between the exemplary embodiment and the previously described embodiments will be emphasized hereinafter.

The capacitive polar plate 430 may be disposed close to the spacing 300 between the first and second reflecting members 110 and 120 so as to form a coupling capacitor 400 with at least one of the first and second reflecting members 110 and 120, to suppress the signal radiated by the antenna device from leaking to the rear side of the antenna device through the spacing 300.

The capacitance of the coupling capacitor 400 is generally decided by its structural parameter, which may specifically include an effective capacitor area and an effective capacitor separation of the coupling capacitor 400. The effective capacitor area may be based on a polar plate area of the capacitive polar plate 430, a width of the spacing 300 between the first reflecting member 110 and the second reflecting member 210 and the like, and the effective capacitor separation may be obtained according to parameters such as a first separation between the capacitive polar plate 430 and the first reflecting member 110, a second separation between the capacitive polar plate 430 and the second reflecting member 210 and the like.

In some embodiments, as shown in FIG. 13, the capacitive polar plate 430 is parallel to at least one of the first and second reflecting members 110 and 210, to increase the capacitance of the coupling capacitor 400 as much as possible, and to improve the radiation effect of the antenna device.

In some embodiments, as shown in FIG. 13, a projection of the capacitive polar plate 430 on a plane where the first reflecting member 110 and the second reflecting member 210 are in covers the spacing 300, so as to reduce signal leakage from the spacing 300 to the rear side of the antenna device as much as possible.

In some embodiments, the first reflecting member 110 and a portion of the capacitive polar plate 430 may be disposed within the first radome, while the second reflecting member 210 and another portion of the capacitive polar plate 430 may be disposed within the second radome. In addition, the capacitive polar plate 430 may be fixed to the radome by a fastener or the like.

The embodiments of the present disclosure may also include the following examples.

An antenna device according to some examples may comprise a first antenna comprising a first reflecting member configured to reflect at least a portion of a signal radiated by the antenna device and a second antenna comprising a second reflecting member configured to reflect at least a portion of the signal radiated by the antenna device. The first reflecting member and the second reflecting member may be separated by a spacing. The antenna device may also comprise a coupling capacitor comprising a first polar plate, and second polar plate. The first polar plate may be on a side of a first reflecting surface of the first reflecting member close to the spacing, and the second polar plate may be on a side of a second reflecting surface of the second reflecting member and close to the spacing.

According to some examples, the first reflecting member of the antenna device may include a first conductive plate disposed at an angle relative to the first reflecting surface, with the first conductive plate configured to form the first polar plate; and/or the second reflecting member may include a second conductive plate disposed at an angle relative to the second reflecting surface, with the second conductive plate configured to form the second polar plate.

According to some examples, the antenna device may include a first capacitive member disposed independently of the first reflecting member, at least a portion of the first capacitive member configured to form the first polar plate; and/or a second capacitive member disposed independently of the second reflecting member, at least a portion of the second capacitive member configured to form the second polar plate.

According to some examples, the first capacitive member of the antenna device may include a first fixing portion and the first polar plate that are connected to each other, with the first fixing portion configured to be mechanically connected to the first reflecting member; and/or the second capacitive member of the antenna device may include a second fixing portion and the second polar plate that are connected to each other, with the second fixing portion configured to be mechanically connected to the second reflecting member. The first fixing portion may include a first fixing plate connected to the first reflecting member in parallel with the first reflecting surface; and/or the second fixing portion may include a second fixing plate connected to the second reflecting member in parallel with the second reflecting surface.

According to some examples, the first polar plate and the second polar plate may be parallel to each other. The first polar plate and the second polar plate may be disposed completely opposite one another. The first polar plate may be disposed perpendicularly to the first reflecting surface; and/or the second polar plate may be disposed perpendicularly to the second reflecting surface.

According to some examples, the first polar plate may extend towards a front side and/or a rear side of the antenna device relative to the first reflecting surface; and/or the second polar plate may extend towards the front side and/or the rear side of the antenna device relative to the second reflecting surface.

According to some examples, the first reflecting surface and the second reflecting surface may be disposed to be coplanar with each other.

According to some examples, the first antenna may comprise a plurality of first antenna elements arranged in an array; and the second antenna may comprise a plurality of third antenna elements arranged in an array; with the first antenna elements and the third antenna elements each configured to radiate first signals within a first frequency band.

According to some examples, the first antenna may comprise a plurality of second antenna elements arranged in an array, the second antenna elements configured to radiate a second signal within a second frequency band; with at least some frequencies in the second frequency band higher than the highest frequency in the first frequency band.

According to some examples, the second antenna may include a plurality of fourth antenna elements arranged in an array, the fourth antenna elements configured to radiate a fourth signal within a fourth frequency band; with at least some frequencies in the fourth frequency band higher than the highest frequency in the first frequency band.

According to some examples, a structural parameter of the coupling capacitor of the antenna device may be configured according to the first signal. The structural parameter of the coupling capacitor may include at least one of a first area of the first polar plate, a second area of the second polar plate, and a polar plate separation between the first polar plate and the second polar plate.

According to some examples, the least one of the first antenna and the second antenna may further include an active apparatus configured to regulate the signal radiated by the antenna device.

According to some examples, the first antenna may include a first radome, with the first polar plate disposed within the first radome; and/or the second antenna may include a second radome, with the second polar plate disposed within the second radome.

An antenna device according to some examples may include a first antenna comprising a first reflecting member that comprises a first reflecting plate configured to reflect at least a portion of a signal radiated by the antenna device and a first polar plate bent at a first preset angle relative to the first reflecting plate; and a second antenna comprising a second reflecting member that comprises a second reflecting plate configured to reflect at least a portion of the signals radiated by the antenna device and a second polar plate bent at a second preset angle relative to the second reflecting plate, and there is a spacing between the first reflecting member and the second reflecting member. The first polar plate and the second polar plate may be disposed close to the spacing, and the first polar plate and the second polar plate form a coupling capacitor.

According to some examples, the first reflecting plate may be disposed integrally with the first polar plate; and the second reflecting plate may be disposed integrally with the second polar plate.

According to some examples, the first polar plate and the second polar plate are parallel to each other.

According to some examples, the first polar plate and the second polar plate are disposed completely opposite one another.

According to some examples, the first preset angle is a right angle; and/or the second preset angle is a right angle.

According to some examples, the first polar plate extends towards a front side and/or a rear side of the antenna device relative to the first reflecting plate; and/or the second polar plate extends towards the front side and/or the rear side of the antenna device relative to the second reflecting plate.

According to some examples, the first reflecting plate and the second reflecting plate may be disposed to be coplanar with each another.

According to some examples, the at least one of the first antenna and the second antenna further includes an active apparatus configured to regulate the signal radiated by the antenna device.

According to some examples, the first antenna further comprises a first radome, the first reflecting member is disposed within the first radome; and/or the second antenna further comprises a second radome, the second reflecting member is disposed within the second radome.

An antenna device according to some examples may comprise a first antenna comprising a first reflecting member configured to reflect at least a portion of a signal radiated by the antenna device and a second antenna comprising a second reflecting member configured to reflect at least a portion of the signal radiated by the antenna device. The first reflecting member and the second reflecting member may be separated by a spacing. The antenna device may also comprise a capacitive polar plate arranged proximate to the spacing, and the capacitive polar plate may form a coupling capacitor with at least one of the first reflecting member and/or the second reflecting member.

According to some examples, the capacitive polar plate may be parallel to at least one of the first reflecting member and the second reflecting member.

According to some examples, the first reflecting member and the second reflecting member may be disposed to be coplanar with each another.

According to some examples, a projection of the capacitive polar plate on a plane where the first reflecting member and the second reflecting member are located covers the spacing.

According to some examples, the first antenna further comprises a plurality of first antenna elements arranged in an array; and the second antenna further comprises a plurality of third antenna elements arranged in an array; where the first antenna element and the third antenna element are configured to radiate first signals within a first frequency band, respectively.

According to some examples, the first antenna further comprises a plurality of second antenna elements arranged in an array, and the second antenna element is configured to radiate a second signal within a second frequency band; with at least some frequencies in the second frequency band higher than the highest frequency in the first frequency band.

According to some examples, the second antenna further comprises a plurality of fourth antenna elements arranged in an array, the fourth antenna element is configured to radiate a fourth signal within a fourth frequency band; with at least some frequencies in the fourth frequency band are higher than the highest frequency in the first frequency band.

According to some examples, a structural parameter of the coupling capacitor may be configured according to the first signal. The structural parameter of the coupling capacitor configured according to the first signal may be at least one of a polar plate area of the capacitive polar plate, a first separation between the capacitive polar plate and the first reflecting member, and/or a second separation between the capacitive polar plate and the second reflecting member.

According to some examples, at least one of the first antenna and the second antenna further may comprise an active antenna.

According to some examples, the first antenna of the antenna device may comprise a first radome, and the first reflecting member and a portion of the capacitive polar plate may be within the first radome; and/or the second antenna of the antenna device may comprise a second radome, and the second reflecting member and a portion of the capacitive polar plate may be disposed within the second radome.

The terms "front," "back," "top," "bottom," "over," "under" and the like, as used herein, if any, are used for descriptive purposes and not necessarily for describing permanent relative positions. It should be understood that such terms are interchangeable under appropriate circumstances such that the embodiments of the disclosure described herein are, for example, capable of operation in other orientations than those illustrated or otherwise described herein.

The term "exemplary", as used herein, means "serving as an example, instance, or illustration", rather than as a "model" that would be exactly duplicated. Any implementation described herein as exemplary is not necessarily to be construed as preferred or advantageous over other implementations. Furthermore, there is no intention to be bound by any expressed or implied theory presented in the preceding technical field, background, summary or detailed description.

The term "substantially", as used herein, is intended to encompass any slight variations due to design or manufacturing imperfections, device or component tolerances, environmental effects and/or other factors. The term "substantially" also allows for variation from a perfect or ideal case due to parasitic effects, noise, and other practical considerations that may be present in an actual implementation.

In addition, the foregoing description may refer to elements or nodes or features being "connected" or "coupled" together. As used herein, unless expressly stated otherwise, "connected" means that one element/node/feature is electrically, mechanically, logically or otherwise directly joined to (or directly communicates with) another element/node/feature. Likewise, unless expressly stated otherwise, "coupled" means that one element/node/feature may be mechanically, electrically, logically or otherwise joined to another element/node/feature in either a direct or indirect manner to permit interaction even though the two features may not be directly connected. That is, "coupled" is intended to encompass both direct and indirect joining of elements or other features, including connection with one or more intervening elements.

In addition, certain terminology, such as the terms "first", "second" and the like, may also be used in the following description for the purpose of reference only, and thus are not intended to be limiting. For example, the terms "first", "second" and other such numerical terms referring to structures or elements do not imply a sequence or order unless clearly indicated by the context.

Further, it should be noted that, the terms "comprise", "include", "have" and any other variants, as used herein, specify the presence of stated features, integers, steps, operations, elements, and/or components, but do not preclude the presence or addition of one or more other features, integers, steps, operations, elements, components, and/or groups thereof.

In this disclosure, the term "provide" is intended in a broad sense to encompass all ways of obtaining an object, thus the expression "providing an object" includes but is not limited to "purchasing", "preparing/manufacturing", "disposing/arranging", "installing/assembling", and/or "ordering" the object, or the like.

Furthermore, those skilled in the art will recognize that boundaries between the above described operations are merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments. However, other modifications, variations and alternatives are also possible. The description and drawings are, accordingly, to be regarded in an illustrative rather than in a restrictive sense.

Although some specific embodiments of the present disclosure have been described in detail with examples, it should be understood by a person skilled in the art that the above examples are only intended to be illustrative but not to limit the scope of the present disclosure. The embodiments disclosed herein can be combined arbitrarily with each other, without departing from the scope and spirit of the present disclosure. It should be understood by a person skilled in the art that the above embodiments can be modified without departing from the scope and spirit of the present disclosure. The scope of the present disclosure is defined by the attached claims.

What is claimed is:

1. An antenna device, comprising:

a first antenna comprising a first radome and a first reflecting member arranged within the first radome and configured to reflect at least a portion of a first signal radiated by the first antenna;

a second antenna vertically stacked with the first antenna, the second antenna comprising a second radome and a second reflecting member arranged within the second radome and configured to reflect at least a portion of a second signal radiated by the second antenna, wherein the first radome and the first reflecting member are separated from the second radome and the second reflecting member by a spacing; and a coupling capacitor comprising a first polar plate extending from the first reflecting member and a second polar plate extending from the second reflecting member, wherein the first polar plate is on a side of a first reflecting surface of the first reflecting member and proximal to the spacing, and wherein the second polar plate is on a side of a second reflecting surface of the second reflecting member and proximal to the spacing.

2. The antenna device according to claim 1, wherein the first reflecting member comprises a first conductive plate disposed at an angle relative to the first reflecting surface, with the first conductive plate configured to form the first polar plate; and/or wherein the second reflecting member comprises a second conductive plate disposed at an angle relative to the second reflecting surface, with the second conductive plate configured to form the second polar plate.

3. The antenna device according to claim 1, wherein the antenna device comprises:

a first capacitive member configured to be connected mechanically to the first reflecting member, with at least a portion of the first capacitive member configured to form the first polar plate; and/or a second capacitive member configured to be connected mechanically to the second reflecting member, with at least a portion of the second capacitive member configured to form the second polar plate.

4. The antenna device according to claim 3, wherein the first capacitive member comprises a first fixing portion and the first polar plate, with the first fixing portion configured to be connected mechanically to the first reflecting member; and/or wherein the second capacitive member comprises a second fixing portion and the second polar plate, with the second fixing portion configured to be connected mechanically to the second reflecting member.

5. The antenna device according to claim 1, wherein the first antenna further comprises a plurality of first antenna elements arranged in an array; wherein the second antenna further comprises a plurality of third antenna elements arranged in an array; and wherein the first antenna elements and the third antenna elements are configured to radiate signals within a first frequency band, respectively.

6. The antenna device according to claim 5, wherein the first antenna further comprises a plurality of second antenna elements arranged in an array, the second antenna elements configured to radiate signals within a second frequency band; and wherein at least some frequencies in the second frequency band are higher than a highest frequency in the first frequency band.

7. The antenna device according to claim 5, wherein the second antenna further comprises a plurality of fourth antenna elements arranged in an array, the fourth antenna elements configured to radiate signals within a fourth frequency band; and wherein at least some frequencies in the fourth frequency band are higher than a highest frequency in the first frequency band.

8. The antenna device according to claim 5, wherein a structural parameter of the coupling capacitor is configured according to the first signal.

9. The antenna device according to claim 8, wherein the structural parameter of the coupling capacitor comprises at least one of a first area of the first polar plate, a second area of the second polar plate, and a polar plate separation between the first polar plate and the second polar plate.

10. The antenna device according to claim 1, wherein at least one of the first antenna and the second antenna further comprises an active antenna.

11. An antenna device, comprising:

a first antenna comprising a first radome and a first reflecting member that is arranged within the first radome and that comprises a first reflecting plate configured to reflect at least a portion of a signal radiated by the antenna device and a first polar plate extending from the first reflecting plate and bent at a first angle relative to the first reflecting plate; and a second antenna vertically stacked with the first antenna, the second antenna comprising a second radome and a second reflecting member that is arranged within the second radome and that comprises a second reflecting plate configured to reflect at least a portion of the signal radiated by the antenna device and a second polar plate extending from the second reflecting plate and bent at a second angle relative to the second reflecting plate, wherein there is a spacing between the first antenna and the second antenna, wherein the first polar plate and the second polar plate form a coupling capacitor.

12. The antenna device according to claim 11, wherein the first reflecting plate is disposed integrally with the first polar plate; and wherein the second reflecting plate is disposed integrally with the second polar plate.

13. The antenna device according to claim 11, wherein the first polar plate and the second polar plate are parallel to each other.

14. An antenna device, comprising:

a first antenna comprising a first radome and a first reflecting member arranged within the first radome and configured to reflect at least a portion of a signal radiated by the first antenna;

a second antenna vertically stacked with the first antenna, the second antenna comprising a second radome and a second reflecting member arranged within the second radome and configured to reflect at least a portion of a signal radiated by the second antenna, wherein the first antenna and the second antenna are separated by a spacing; and a capacitive polar plate arranged proximate to the spacing, wherein the capacitive polar plate and at least one of the first reflecting member and/or the second reflecting member form a coupling capacitor.

15. The antenna device according to claim 14, wherein the capacitive polar plate is parallel to at least one of the first reflecting member and/or the second reflecting member.

16. The antenna device according to claim 14, wherein the first reflecting member and the second reflecting member are coplanar with each another.

17. The antenna device according to claim 14, wherein the first antenna further comprises a plurality of first antenna elements arranged in an array, wherein the second antenna further comprises a plurality of third antenna elements arranged in an array, and wherein the first antenna elements and the third antenna elements are each configured to radiate signals within a first frequency band.

18. The antenna device according to claim 17, wherein the first antenna further comprises a plurality of second antenna elements arranged in an array, wherein the second antenna elements are configured to radiate signals within a second frequency band, and wherein at least some frequencies in the second frequency band are higher than a highest frequency in the first frequency band.

19. The antenna device according to claim 17, wherein the second antenna further comprises a plurality of fourth antenna elements arranged in an array, wherein the fourth antenna elements are configured to radiate signals within a fourth frequency band, and wherein at least some frequencies in the fourth frequency band are higher than a highest frequency in the first frequency band.

20. The antenna device according to claim 17, wherein a structural parameter of the coupling capacitor is configured according to the first frequency band, and wherein the structural parameter of the coupling capacitor comprises at least one of a polar plate area of the capacitive polar plate, a first separation between the capacitive polar plate and the first reflecting member, and/or a second separation between the capacitive polar plate and the second reflecting member.

* * * * *